US006758137B2

(12) United States Patent
Principe

(10) Patent No.: US 6,758,137 B2
(45) Date of Patent: Jul. 6, 2004

(54) SILK-SCREEN PRINTING MACHINE IN SIMPLIFIED REGISTER

(75) Inventor: Giuseppe Principe, Milan (IT)

(73) Assignee: Siasprint S.r.l., Milan (IT)

( * ) Notice: Subject to any disclaimer, the term of this patent is extended or adjusted under 35 U.S.C. 154(b) by 0 days.

(21) Appl. No.: 10/632,937

(22) Filed: Aug. 1, 2003

(65) Prior Publication Data

US 2004/0020381 A1 Feb. 5, 2004

(51) Int. Cl.[7] ..... B05C 17/04
(52) U.S. Cl. ..... 101/118; 101/126
(58) Field of Search ..... 101/114, 116, 101/117, 118, 123, 126, 129

(56) References Cited

U.S. PATENT DOCUMENTS 3,505,951 A * 4/1970 Gartrell et al. ..... 101/123
3,779,160 A * 12/1973 Black et al. ..... 101/115
4,193,344 A * 3/1980 Ericsson ..... 101/126
4,777,509 A * 10/1988 Komatsubara et al. ..... 101/178
5,782,179 A * 7/1998 Kawaga et al. ..... 101/128.4
6,129,013 A * 10/2000 Takasawa et al. ..... 101/114
2002/0148369 A1 * 10/2002 Yamasaki ..... 101/123

FOREIGN PATENT DOCUMENTS

JP 357025959 * 2/1982

* cited by examiner

*Primary Examiner*—Eugene H. Eickholt

(57) ABSTRACT

A silk-screen printing machine in simplified register comprising a bearer structure (12) on which a silk-screen printing frame is arranged, elements in register (18) of the position of a sheet element to be printed (15) in a supply plane (14), means (34) for detecting the position of the sheet in register (15) and at least one pincer-carrying rod (16) suitable for pulling the sheet (15) on a printing plane (13), is equipped with a group for registering the sheet (15), which is arranged upstream of the pincer-carrying rod (16) and comprises a transversal plate (17) for supporting the sheet and able to translate towards the pincer-carrying rod (16), a plurality of the mobile elements in register (18) suitable for interacting downstream of the plate (17) with the supply plane (14) of the sheet and a plurality of presser elements (19) arranged in a position above the support plate (17) and mobile towards it to engage the sheet (15).

9 Claims, 4 Drawing Sheets

10
12
13
14
15
16
17
18
19
23
24
25
26
27
28
29
30
31
32
33
37
38
40

SILK-SCREEN PRINTING MACHINE IN SIMPLIFIED REGISTER

The present invention refers to a silk-screen printing machine in simplified register.

As is known, in silk-screen printing machines equipped with a bearer structure and a printing head mobile on a silk-screen printing frame, the sheet is moved forward mechanically or manually until it reaches a predetermined position in a pincer for its transportation below the silk-screen printing frame.

Pincer-carrying rods are moved, each at least at its ends by chains, which make them move forward on the printing plane, pulling the sheet to be printed at the various work stations and/or printing heads.

Each pincer consists of a box-shaped body with a rectangular plan and is equipped with openable jaws to grip the sheet and to allow the insertion and removal thereof.

The stop position of the sheet before being gripped is determined by elements in register, which from above engage the supply plane of the sheet in the pincer and which prevent the sheet from advancing beyond the desired position.

The closing of the pincers to grip the sheet is then commanded by an authorisation signal transmitted by one or more photocells aligned with the elements in register.

In silk-screen printing machines thus realised, however, numerous drawbacks have been encountered due to the complex sequence of movements necessary to avoid hindering the members in movement.

Moreover, known silk-screen printing machines are not very flexible compared to the size of the sheets which can be supplied to the machine.

The purpose of the present invention is that of realising a silk-screen printing machine in simplified register which allows high precision supply of the sheets in the pincers to be obtained.

Another purpose of the present invention is that of realising a silk-screen printing machine in simplified register which is adaptable to different sizes of sheets to be printed in a quick and simple manner.

Another purpose of the present invention is that of realising a silk-screen printing machine in simplified register which is particularly simple and functional, with contained costs.

These purposes according to the present invention are accomplished by realising a silk-screen printing machine in simplified register as outlined in claim 1. Further characteristics are foreseen in the dependent claims.

The characteristics and advantages of a silk-screen printing machine in simplified register according to the present invention shall become clearer from the following description, given as an example and not for limiting purposes, referring to the attached schematic drawings, in which.

Figure 1:
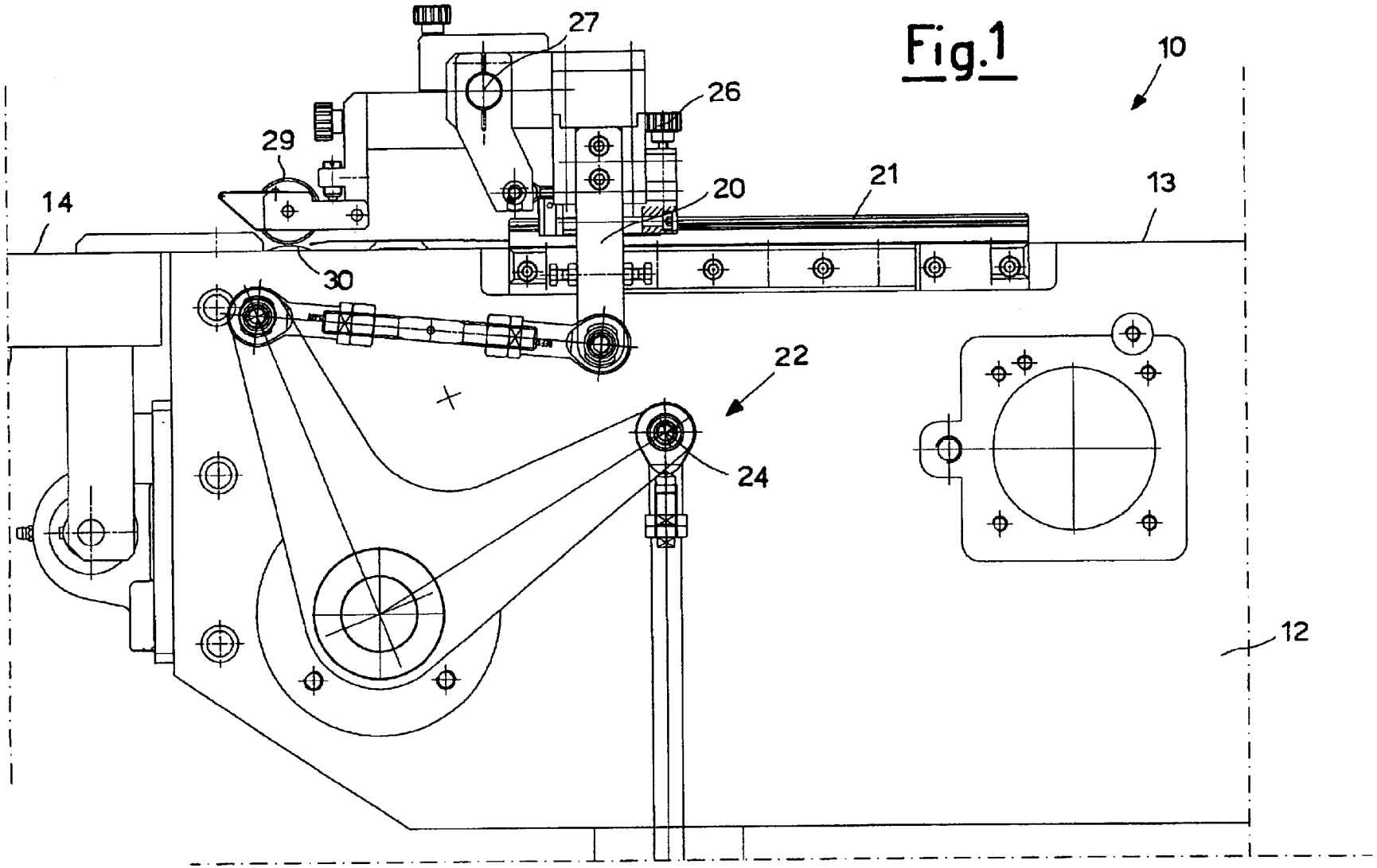
FIG. 1 is a top side view of the side head of the supply zone of sheet elements to be printed of a silk-screen printing machine in simplified register.

With reference to the figures, a silk-screen printing machine in simplified register is shown, wholly indicated with 10 and comprising a bearer structure 12 on which a silk-screen printing frame (not shown) is arranged, to which a sheet element to be printed 15, consisting, for example, of a sheet of paper or another support for the silk-screen printer, is conveyed in a supply plane 14. The supply plane 14 extends in a subsequent printing plane 13, only partially indicated, lying below the silk-screen printing frame.

One or generally more pincer-carrying rods 16 mounted on chains arranged in a loop, not shown, grip the sheet and pull it on the printing plane 13 between the different work stations according to that which is known.

In the supply zone of a sheet element to be printed 15 of the silk-screen printing machine in simplified register, object of the present invention, a group for registering the sheet element to be printed is arranged upstream of the pincer-carrying rod 16.

Figure 2:
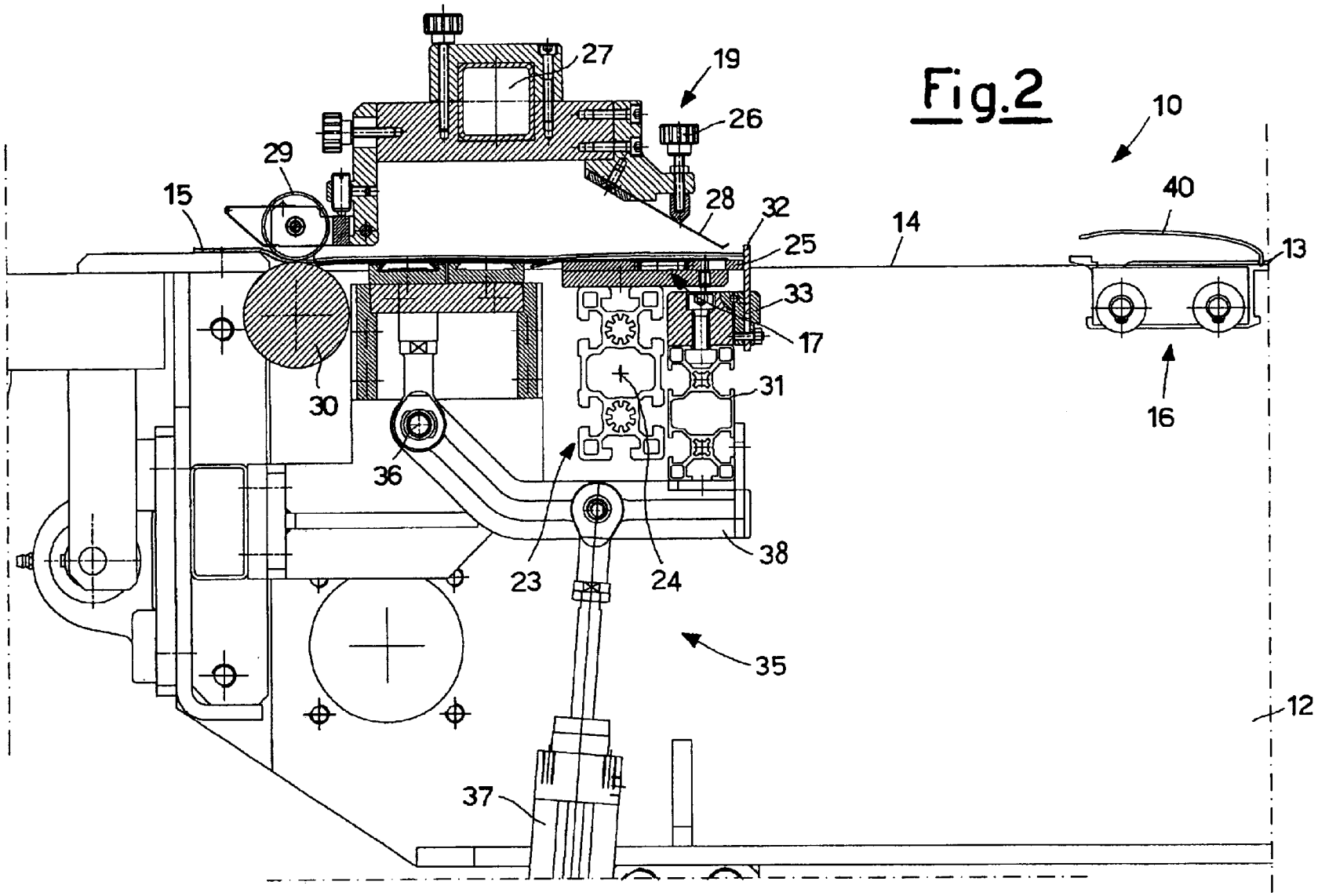
FIG. 2 is a top side section view realised in a transversal plane in the positioning in register step of a sheet to be printed.
Figure 3:
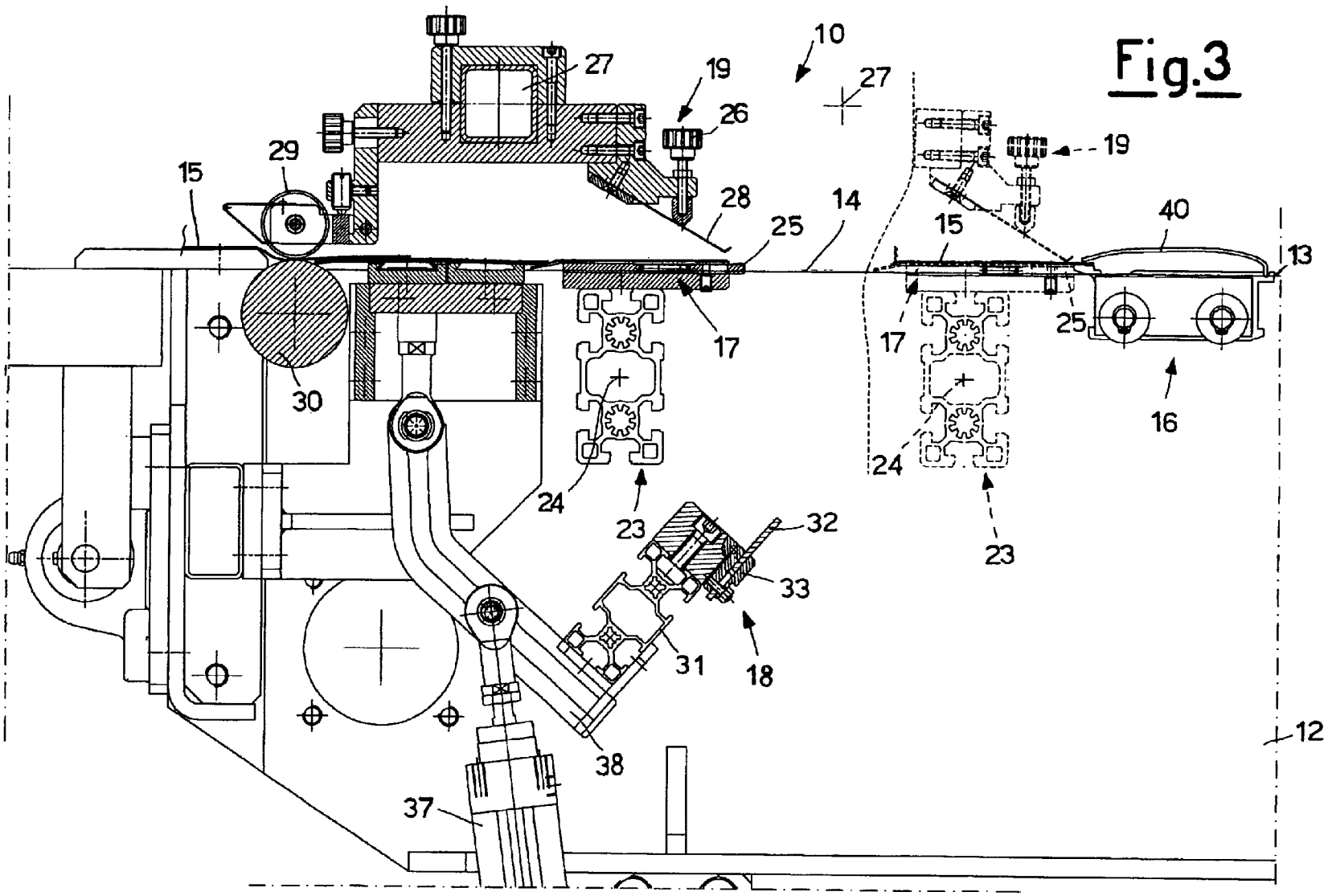
FIG. 3 shows the section view of FIG. 2 of the silk-screen printing machine in simplified register, object of the present invention, in a solid line in an intermediate operating step and in a broken line in the sheet gripping step.
Figure 4:
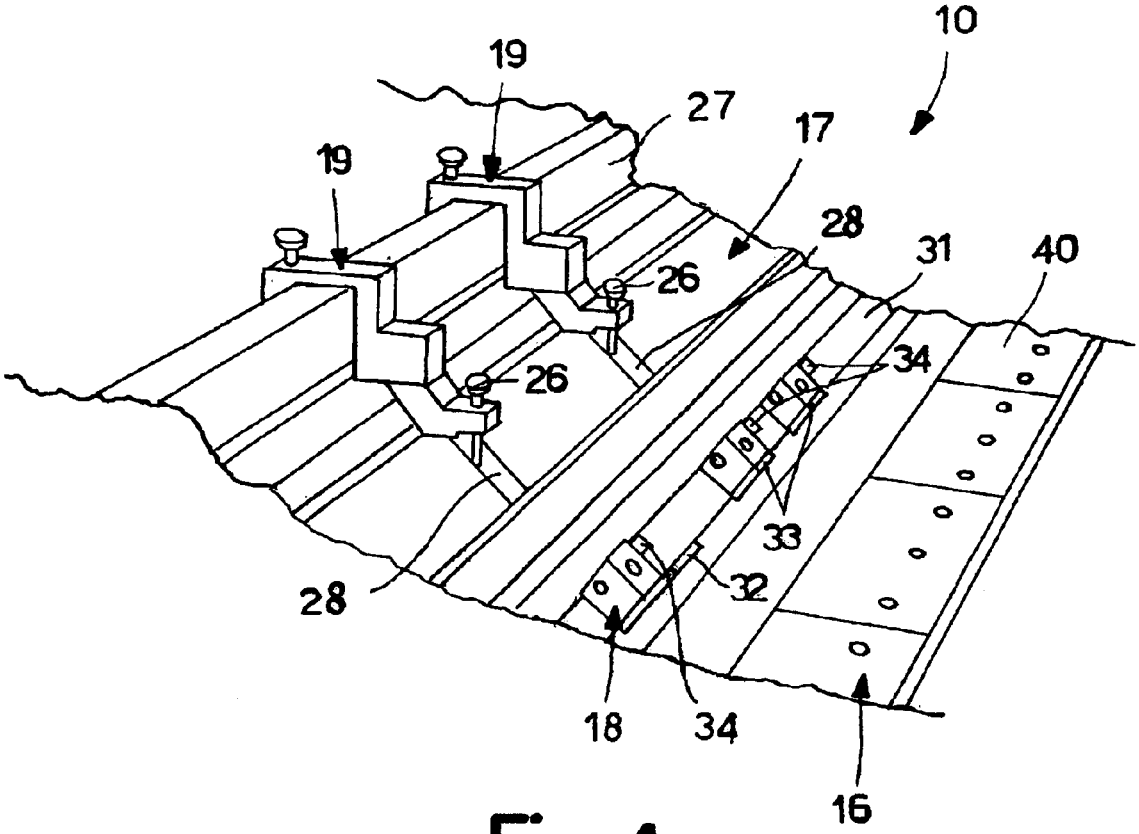
FIG. 4 is a perspective view of a detail of the supply zone of FIG. 3.

The registering group, shown in detail in FIGS. 2 and 3, comprises a transversal support plate 17 for a front portion of the sheet 15, as well as a plurality of mobile elements in register 18 suitable for interacting with the supply plane 14 of the sheet immediately downstream of the plate 17 to intercept the sheet 15 in the correct position.

The sheet 15 is kept in the register position by a plurality of presser elements 19, also belonging to the registering group, arranged in position above the support plate 17 and mobile towards it to engage the sheet 15.

The plate 17 and the presser elements 19 can translate towards the pincer-carrying rod 16, being mounted integral with a slide 20 mobile on rails 21 in the longitudinal direction, as shown in FIG. 1. The slide 20, actuated by an oscillating lever mechanism 22, commanded by a known actuator which is not shown, has a predeterminable and variable stroke to allow the adjustment of the insertion of the sheet 15 in the pincer-carrying rod 16.

The support plate 17 is mounted on profiled elements 23 arranged transversally with respect to the supply plane 14 and attached at 24 to the slide 20.

The plate 17 is also equipped with frontally protruding elements 25, which are elastically retractable when pressed into abutment against the pincer-carrying rod 16, for example according to that which is shown with a broken line in FIG. 3.

The presser elements 19 consist of a plurality of inclined elastic metal foils 28, on which means for adjusting the pressure 26 act. The presser elements 19 are slidably mounted at an upper transversal rod 27, oscillating about a transversal axis thereof.

The upper transversal rod 27 also carries, on the opposite side to the presser elements 19, a supply roller 29 of the sheet. Such a roller 29 is idle and interfaces a motor roller 30 mounted on the bearer structure 12 of the machine 10.

The oscillating motion of the upper rod 27 alternatively allows the sheet 15 to be supplied leaving the presser elements 19 in disengaged position before carrying out the position registration (FIGS. 2 and 3 in a solid line), or else allows the sheet 15 to be engaged against the support plate 17 interrupting its supply in the plane 14 (FIG. 3 in a broken line). The presser elements 19 can be positioned in any point of the rod 27 at whatever interval to obtain the best engagement with the sheet in register 15 based upon the specific working conditions.

The elements in register 18 of the silk-screen printing machine in simplified register 10, object of the present invention, are slidably applied to a transversal guide 31 positioned below the supply plane 14. The elements in register 18 comprise a metal foil 32 protruding from a base body 33, in which, in a preferred embodiment, the means 34 for detecting the presence of the sheet 15 are housed.

The detection means 34, for example consisting of photocells or fibre optic sensors, transfer a authorisation signal for the transfer of the sheet 15 towards the pincer-carrying rod 16 to the oscillating lever mechanism 22 of the slide 20.

The transversal guide 31, realised as a box-shaped profile, is commanded by an actuator device 35 which determines its engagement and disengagement from the supply plane 14 of the sheet 15. In the example proposed in the figures, the guide 34 and the elements in register 18 are equipped with rotary motion about a fixed fulcrum 36, commanded by an actuator device consisting of a piston 37 and a lever 38. The piston 37 is hinged at the bottom to a fixed point of the bearer structure 12 and at the top to the lever 38, which in turn is pivoted to a first end thereof at 36 and carries the transversal guide 31 at the opposite end. The foils 32 are advantageously realised retractably into the base body 33, so as to be able to be rapidly activated or deactivated based upon the specific printing requirements, without the need to dismount the non-useful or even counterproductive elements in register 18 for the optimal positioning in register of a sheet element to be printed 15.

The pincer-carrying rod 16 comprises a plurality of pincer elements, schematised in FIGS. 2 and 3, equipped with jaws 40, mobile according to known ways. Their edge for gripping on the sheet 15 is advantageously smooth and without seats or recesses. This allows elements pressed, possibly also with high forces, on the edge of the pincers not to be damaged during the successive printing operations.

In FIG. 3, with a solid line, the initial step of supplying the sheet 15 in the plane 14 is shown, in which the elements in register 18 are in non-operative position. In FIG. 2, on the other hand, the sheet element to be printed 15 is represented in register position in abutment against the elements in register 18, which are in their active intercepting position of the supply plane 14 immediately downstream of the protruding elements 25 of the support plate 17. In this step the presser elements 19 are still disengaged with respect to the sheet 15.

When the presence of the sheet in register 15 is indicated through the detection means 34, the oscillation of the upper rod 27 places the presser elements 19 in engagement with the sheet 15. The disengagement of the elements in register 18 from the plane 14 is realised through the rotation of the transversal guide 31, to which they are applied, about the fulcrum 36 (FIG. 3).

Then the support plate 17 and the presser elements 19, which hold the sheet 15, can move forwards pulled by the movement of the slide 20 towards the pincer-carrying rod 16, going into the position shown with a broken line in FIG. 3.

The front edge of the sheet 15 is then held between the jaws 40 of the pincer elements, which will pull it on the printing plane 13 for the printing steps.

To prepare for the supply of a new sheet element to be printed 15 the members of the silk-screen printing machine in simplified register 10 then go back into the starting position shown with a solid line in FIG. 3.

The silk-screen printing machine in simplified register object of the present invention has the advantage of realising the positioning of the sheet element to be printed upstream of the pincer-carrying rod, so that the registration group does not hinder the movement of the rod.

Moreover, the registering group comprises a plurality of elements in register and presser elements mobile in a direction transversal to the supply plane of the sheet and easily adaptable in an advantageous manner to the specific sizes and shapes of the sheet.

The silk-screen printing machine in simplified register thus conceived is susceptible to numerous modifications and variants, all covered by the invention; moreover, all of the detail can be replaced by technically equivalent elements. In practice, the materials used, as well as the sizes, can be whatever according to the technical requirements.

I claim:

1. Silk-screen printing machine in simplified register comprising a bearer structure (12) on which a silk-screen printing frame is arranged, elements in register (18) of the position of a sheet element to be printed (15) in a supply plane (14), means (34) for detecting the position of said sheet in register (15) and at least one pincer-carrying rod (16) suitable for pulling said sheet (15) on a printing plane (13), characterised in that it is equipped with a group for registering said sheet (15), where said group is arranged upstream of said pincer-carrying rod (16) and comprises a transversal plate (17) for supporting the sheet and able to translate towards said pincer-carrying rod (16), a plurality of said mobile elements in register (18) suitable for interacting downstream of said plate (17) with said supply plane (14) of the sheet and a plurality of presser elements (19) arranged in a position above said support plate (17) and mobile towards it to engage said sheet (15), said support plate (17) and said presser elements (19) being mounted integral with a slide (20) mobile in the longitudinal direction towards said pincer-carrying rod (16).

2. Machine according to claim 1, characterised in that a front edge of said transversal support plate (17) is equipped with protruding elements (25) which are elastically retractable when pressed into abutment against said pincer-carrying rod (16).

3. Machine according to claim 1, characterised in that said slide (20) is commanded by an oscillating lever mechanism (22) and is equipped with a stroke which can be predetermined and variable.

4. Machine according to claim 1, characterised in that said elements in register (18) each consist of a foil (32) protruding from a base body (33), said base (33) being slidably inserted in a transversal guide (31) positioned below the supply plane (14) and commanded by an actuator device (35) which determines its engagement and disengagement from said plane (14).

5. Machine according to claim 4, characterised in that said actuator device (35) is a piston (37) hinged at ends respectively below to a fixed point of the structure (12) and above to a lever (38), said lever (38) being hinged at an end thereof to a fixed fulcrum (36) and carrying, at the opposite end, said transversal guide (31).

6. Machine according to claim 4, characterised in that said foils (32) are retractable into said base (33).

7. Machine according to claim 4, characterised in that said means (34) for detecting the presence of the sheet in register are housed integrally in said base body (33), in which said detection means (34) transfer an authorisation signal to the command mechanism (22) of said slide (20).

8. Machine according to claim 1, characterised in that said presser elements (19) are mounted at an upper transversal rod (27) oscillating about a transversal axis thereof.

9. Machine according to claim 1, characterised in that said presser elements (19) consist of inclined elastic foils (28) on which means for adjusting the pressure (26) act.

* * * * *